United States Patent [19]

Miner, Jr. et al.

[11] Patent Number: 4,849,987

[45] Date of Patent: Jul. 18, 1989

[54] COMBINATION LEFT AND RIGHT HANDED FURNACE ROOF

[75] Inventors: Frank H. Miner, Jr., North Olmsted; Arthur M. Siffer, Toledo, both of Ohio

[73] Assignee: Union Carbide Corporation, Danbury, Conn.

[21] Appl. No.: 259,898

[22] Filed: Oct. 19, 1988

[51] Int. Cl.[4] ..... F27D 1/12

[52] U.S. Cl. ..... 373/74

[58] Field of Search ..... 373/73, 74, 75, 76; 266/241, 240; 432/157, 160, 238, 233, 237

[56] References Cited

U.S. PATENT DOCUMENTS

| | | | |
|---|---|---|---|
| 1,840,247 | 1/1932 | Northrup . | |
| 3,388,737 | 6/1968 | Buckwalter et al. | 164/283 |
| 3,429,973 | 2/1969 | Carter et al. . | |
| 3,858,861 | 1/1975 | Jernigan | 266/32 |
| 4,107,449 | 8/1978 | Sosonkin et al. . | |
| 4,132,852 | 1/1979 | Andoniev et al. . | |
| 4,197,422 | 4/1980 | Fuchs et al. . | |
| 4,216,348 | 8/1980 | Greenberger . | |
| 4,239,484 | 12/1980 | Schuster | 432/77 |
| 4,273,949 | 6/1981 | Fischer et al. . | |
| 4,345,332 | 8/1982 | Wronka | 373/74 |
| 4,443,188 | 4/1984 | Buhler | 432/233 |
| 4,494,594 | 1/1985 | Kurzinski | 164/443 |
| 4,633,480 | 12/1986 | Bleimann | 373/74 |
| 4,715,042 | 12/1987 | Heggart et al. | 373/74 |

FOREIGN PATENT DOCUMENTS

| | | | |
|---|---|---|---|
| 1108372 | 10/1957 | Fed. Rep. of Germany . | |
| 3027465 | 3/1982 | Fed. Rep. of Germany . | |
| 45-29728 | 9/1970 | Japan . | |
| 57-48615 | 10/1982 | Japan . | |
| 86817 | 1/1956 | Norway | 373/74 |

*Primary Examiner*—Roy N. Envall, Jr.
*Attorney, Agent, or Firm*—Cornelius F. O'Brien

[57] ABSTRACT

A combination left- and right-handed roof system adapted for use in electric arc or other furnaces having roof removal in either a clockwise or counterclockwise direction. The roof system is spray cooled by a coolant and includes a coolant drain system divided into at least two segments and having opposing inlets for receiving spent coolant. Two pairs of adjacent coolant outlets are provided for connection with a coolant collection pump, depending upon the direction of roof removal, and each outlet in each of the pairs is associated with a different drain system segment. A removable U-shaped conduit connects the two outlets of the pair disconnected from the coolant collection pump. Coolant may flow from one inlet, directly through a single drain system segment, and be removed from the roof through one of the connected outlets. Coolant may independently flow from the opposite inlet, through the U-shaped conduit and another drain segment, and be removed from the roof through the other connected outlet.

15 Claims, 6 Drawing Sheets

FIG. 4
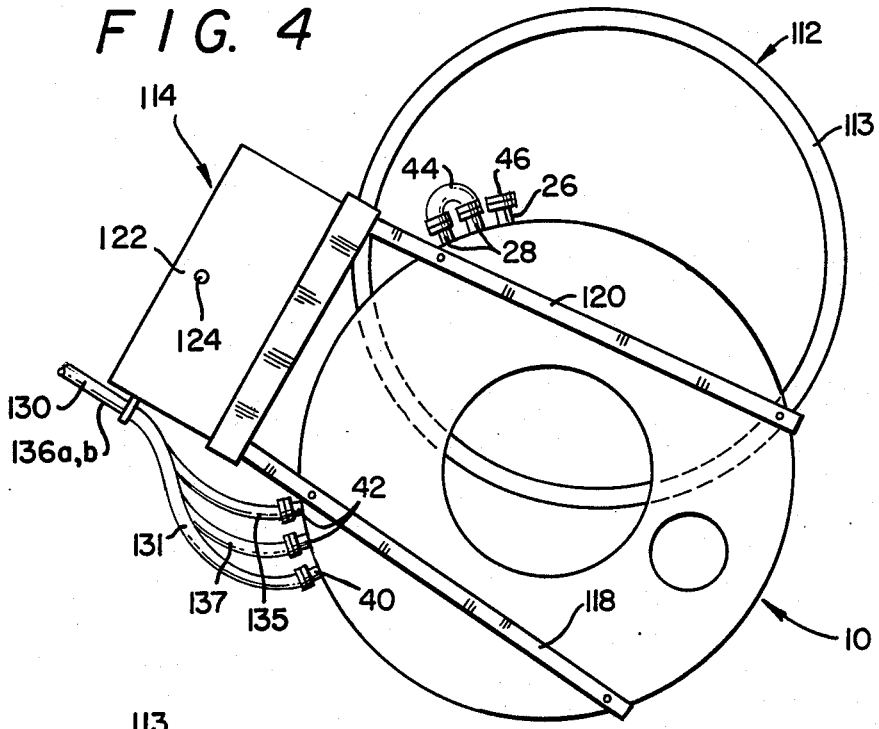
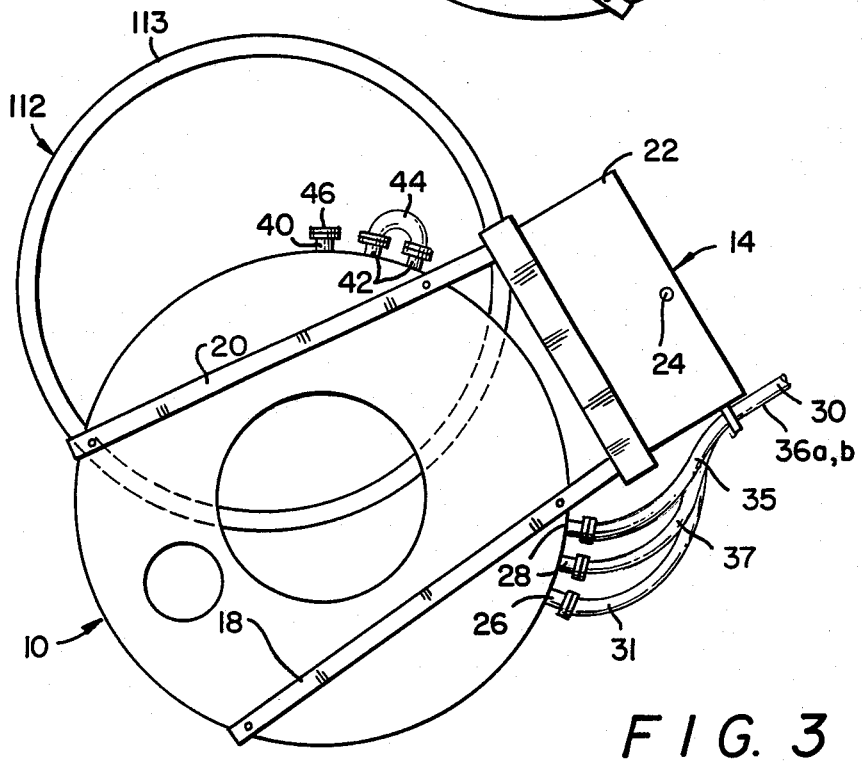
FIG. 3

COMBINATION LEFT AND RIGHT HANDED FURNACE ROOF

BACKGROUND OF THE INVENTION

This invention relates to an improved furnace roof and, in particular, an improved roof for large scale molten material processing furnaces such as electric arc steel making furnaces and the like.

Modernization of the steel industry has resulted in, among other things, the introduction of new, lighter, water cooled roofs for electric arc furnaces which have considerably longer life than previous roof designs. These new water cooled roofs in some cases almost completely eliminate the necessity of thermal refractory linings, and their use has contributed considerable savings to the steel industry. Typical of these water-cooled roof systems are the roofs disclosed in U.S. Pat. No. 4,715,042 and co-pending U.S. patent application Ser. No. 165,609, filed Mar. 8, 1988, the disclosures of which are hereby incorporated by reference. Such water cooled roofs have largely been retrofitted to existing furnace systems and require hook-ups with externally located coolant circulation systems to supply water to and drain water from these roofs. The connection between the roof and the circulation system has generally been through flexible hose or the like which extend from the roof mast structure to the roof itself.

The roof mast structure in electric arc furnaces operates to reposition the roof relative to the underlying furnace and open the furnace top, for example, during initial loading or charging of scrap into the furnace, and at other times during or following furnace operation. The mast structure generally includes a post located adjacent to the furnace vessel upon which pivots a roof supporting structure. This supporting structure usually comprises arms extending out over the top of the furnace and downwardly extending chains or bars to which the roof itself is attached. The supporting structure is able to lift up the roof and swing it to the side or some other position to allow access to the open top of the furnace.

These pivoting mast and roof structures are generally made to swing the roof away from the furnace in only one direction, that is, as seen in a downward plan view, either clockwise or counterclockwise around the mast post. These clockwise and counterclockwise-opening furnace roofs are respectively known as "right-handed" and "left handed" furnace roofs because of the direction of swing opening the furnace relative to the mast post. Because the furnace roof may be opened during furnace operation or immediately afterwards, it is important that heat sensitive portions of the mast and roof structure exposed to the heat be adequately shielded, including the roof coolant connections. To avoid exposing the roof coolant connecting hoses to the extremely hot conditions of the furnace interior, the coolant inlet and outlet on the furnace roof and the associated connecting hoses are positioned so that they are opposite the side of the roof which swings over the open furnace. The hose connections are generally as close to the mast post as possible to minimize the length of hose and the possibility for interference. As viewed in a downward plan view of a typical furnace installation with the mast post at 6 o'clock, the left-handed roof configuration will have the coolant inlet and outlet connectors at approximately a 7 to 8 o'clock position, whereas the right-handed roof configuration will have the coolant inlet and outlets in approximately a 4 to 5 o'clock position.

Electric arc steel making installations will generally keep a backup or spare roof on hand for changeover during maintenance or emergencies. If a steel making installation has arc furnaces with both left- and right-handed roofs, there will have to be kept on hand both a left-handed and right-handed roof spare, even though the furnaces may be identical in other respects. Except for the location of coolant inlet and outlets on the furnace roof, only one spare might otherwise be required for backup purposes, at a considerable cost savings in direct expenditure and inventory costs.

Bearing in mind these and other considerations of the prior art, it is an object of the present invention to provide an improved roof for furnaces which may be utilized in both left-handed and right-handed furnace roof installations.

It is another object of the present invention to provide a combination left and right-handed furnace roof system which provides for water cooled roofs which are divided into different segments for coolant draining.

It is a further object of the present invention to provide a furnace roof system which eliminates the need for additional costly spare roofs in inventory to assure rapid changeover.

It is yet another object of the present invention to provide a furnace roof system which meets the aforestated objects in a simple and cost effective manner.

SUMMARY OF THE INVENTION

The above and other objects, which will be apparent to those skilled in the art, are achieved in the present invention which provides a combination left and right-handed roof for use in electric arc furnaces and other types of furnaces in which the roof may be installed for removal in different directions. The invention provides a roof system comprising a furnace roof having at least a portion thereof cooled by a coolant, and means on the roof to secure the roof to a mast structure or other means to remove the roof from the furnace in either a first or second predetermined direction. A coolant drain system, divided into at least two segments, is provided for receiving spent coolant from the spray cooled portion of the roof. A first set of coolant outlets is provided on the roof drain system for connection with a coolant collection system to permit removal of coolant when the roof is secured for removal in the first direction. Each of the outlets in the first set is connected to a different drain system segment. A second set of coolant outlets, spaced from the first set of coolant outlets, is additionally provided on the roof drain system for connection with a coolant collection system to permit removal of coolant when the roof is secured for removal in the second direction. Each of the outlets in the second set is connected to a different drain system segment.

The second set of outlets is normally disconnected from the coolant collection system when the roof is secured for removal in the first direction, while the first coolant set of outlets is normally disconnected from the coolant collection system when the roof is secured for removal in the second direction. Preferably, each set of coolant outlets comprises an adjacent pair of outlet pipes. Removable connection means, such as a U-shaped conduit, may be secured between the outlets disconnected from the coolant collection system to provide unobstructed communication between the coolant outlets and permit flow of spent coolant between the drain system segments.

The invention is especially adapted for use with spray cooled furnace roofs in tilting electric arc furnaces and the like. Such roofs have upper and lower panels which define a space therebetween and means for directing a spray of coolant, preferably water, against the lower panels to maintain the lower panels at a desired temperature range. The coolant collection system utilizes jet pump or other means for maintaining a pressure differential between the roof interior and the coolant outlets to remove spent coolant from the roof.

The coolant drain system preferably includes drain inlets on opposing sides of the roof and aligned perpendicular to a tilting axis of the furnace. One of the drain inlets is in direct communication, via one of the drain system segments, with one of the drain outlets connected to the coolant collection system, while the opposite drain inlet is in communication, via the connection means and another drain system segment, with another of the drain outlets. Separate pump means may be utilized for each of the connected drain outlets for independently removing spent coolant from each of the drain outlets and associated drain inlets.

BRIEF DESCRIPTION OF THE DRAWINGS

FIG. 3 illustrates a top plan view of an electric arc furnace installation showing the furnace roof system of the present invention being utilized in a left-handed configuration as it is swung away in a counterclockwise direction from an arc furnace vessel.

FIG. 4 is a top plan view of an electric arc furnace installation showing the roof system of the present invention being utilized as a right-handed furnace roof as it is swung away in a clockwise direction from an arc furnace vessel.

DETAILED DESCRIPTION OF THE INVENTION

Preferred embodiments of the present invention are illustrated in FIGS. 1–6*a* in which like numerals refer to like features of the invention. The figures illustrate a typical electric arc furnace installation as used for steel making, although the furnace roof system of the present invention can be utilized in any type of molten material processing vessel in which the roof may be removed in different directions.

Figure 1:
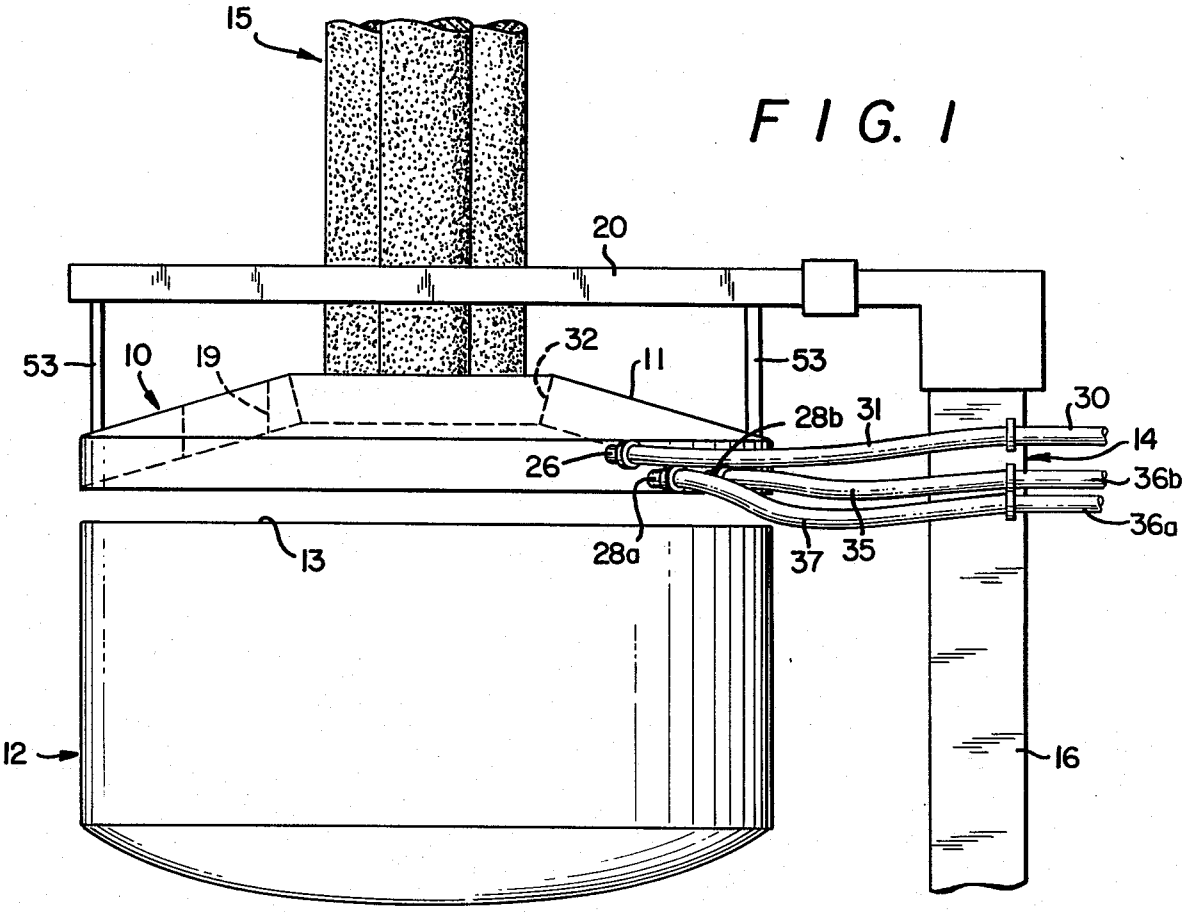
FIG. 1 is a side elevational view of a typical electric furnace installation showing a furnace vessel, a furnace roof in a raised position over the furnace vessel and a mast supporting structure for the roof.
Figure 2:
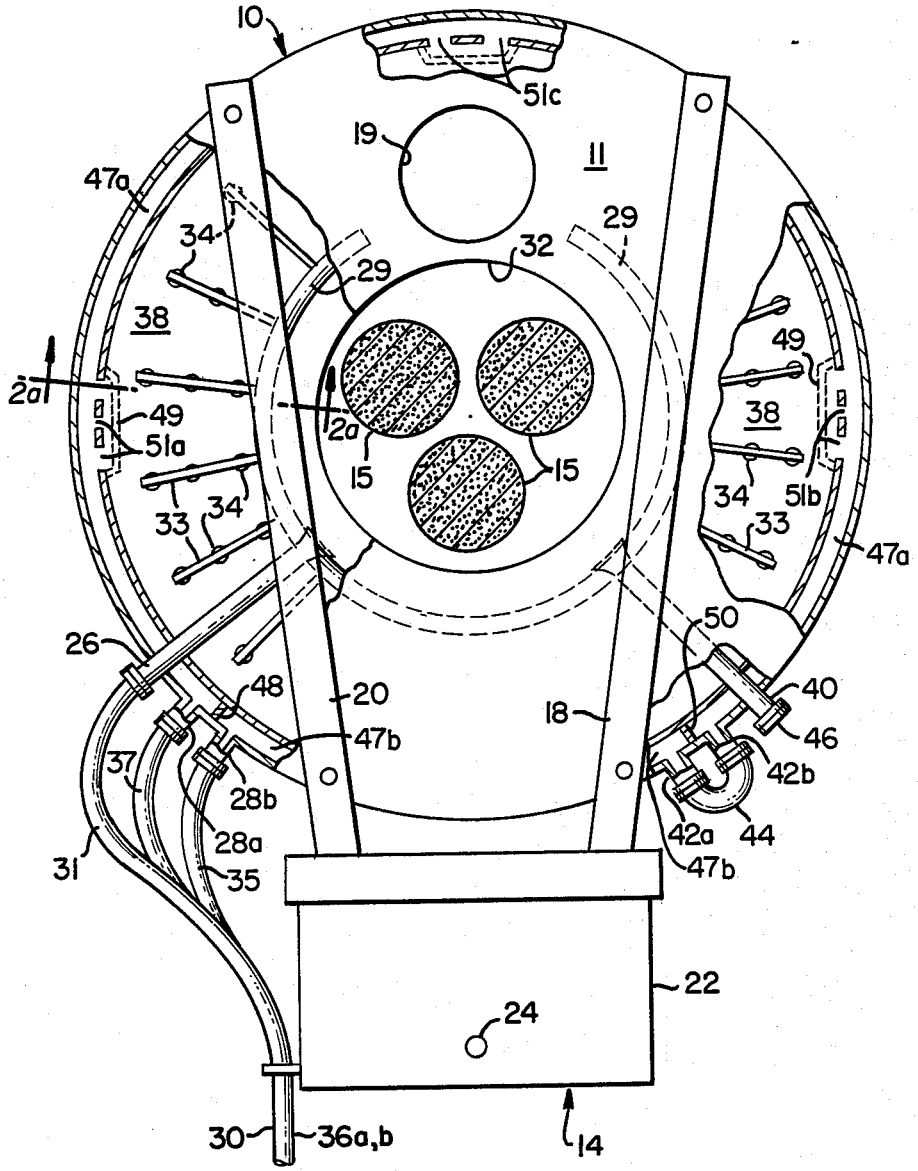
FIG. 2 is a top plan view, partially cut away and partially in section, of a first embodiment of the furnace roof and supporting mast structure of FIG. 1.
Figure 5:
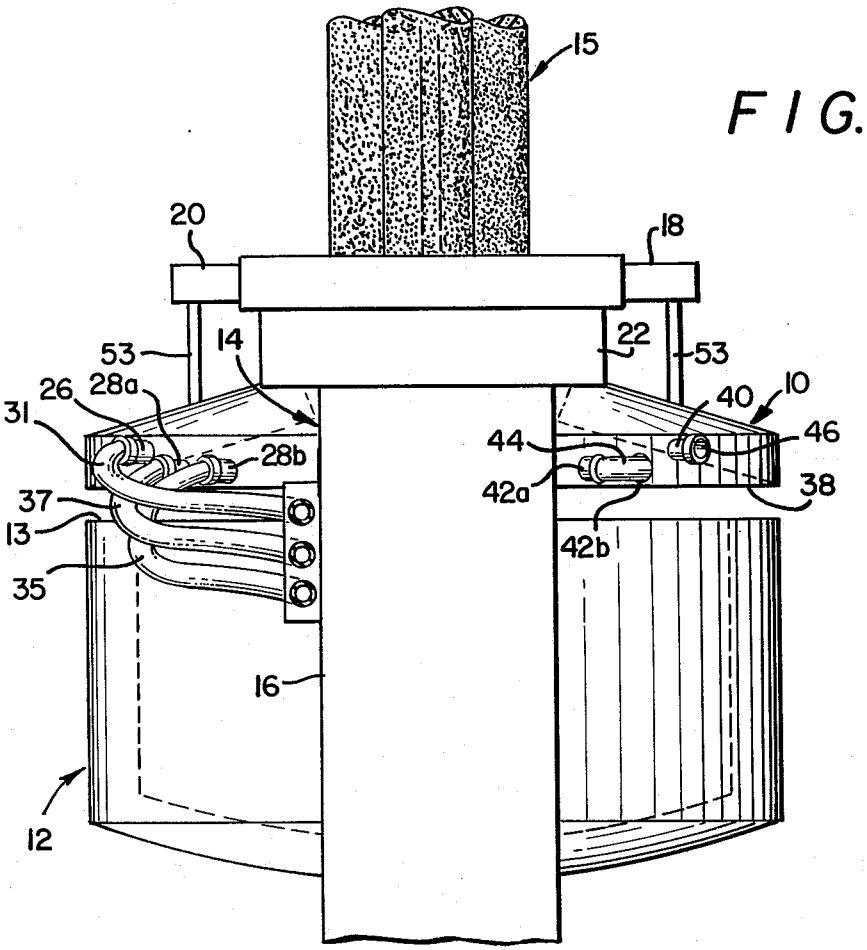
FIG. 5 is an end elevational view of the electric furnace installation of FIG. 1.

FIGS. 1, 2 and 5 illustrate a first embodiment of the electric arc furnace installation in side, top and end views, respectively. The circular water cooled furnace roof 10 is shown being supported by a furnace mast structure 14 in a slightly raised position directly over the rim 13 of electric arc furnace vessel 12. As shown in FIGS. 1 and 2, the roof 10 is attached by chains, cables or other roof lift members 53 to mast arms 18 and 20 which extend horizontally and spread outward from mast support 22. Mast support 22 is able to pivot around point 24 on the upper portion of vertical mast post 16 to swing roof 10 horizontally to the side to expose the open top of furnace vessel 12 during charging or loading of the furnace, and at other appropriate times during or after furnace operation. Electrodes 15 are shown extending into opening 32 from a position above roof 10. During operation of the furnace, electrodes 15 are lowered through electrode ports of a delta in the central roof opening 32 into the furnace interior to provide the electric arc-generated heat to melt the charge. Exhaust port 19 permits removal of fumes generated from the furnace interior during operation.

The furnace system is mounted on trunnions or other means (not shown) to permit the vessel 12 to be tilted in either direction to pour off slag and molten steel. As shown in end elevational view in FIG. 5, the entire furnace may tilt to either the right or the left to pour off slag or steel from openings below furnace rim 13 (not shown) on the extreme right and left of vessel 12. The furnace will tilt about 15° from horizontal to pour off slag in one direction and will tilt about 45° from horizontal to pour steel in the opposite direction.

The furnace roof system shown in FIGS. 1, 2, 3 and 5 is set up to be used as a left-handed system whereby the mast 14 may pick up roof 10 and swing it horizontally in a counterclockwise manner (as seen from above) clear of the furnace rim 13 to expose the furnace interior. To prevent excessive heat buildup on the lower panels 38 of roof 10 as they are exposed to the interior of furnace vessel 12, a roof cooling system is incorporated therein. The cooling system utilizes a fluid coolant such as water or some other suitable liquid to maintain the furnace roof at a predetermined temperature. Any suitable cooling system may be utilized, although the systems described in the aforementioned U.S. Pat. No. 4,715,042 and U.S. patent application Ser. No. 165,609 are preferred. Coolant inlet pipe 26 and outlet pipes 28*a* and 28*b* comprise the coolant connection means for this left-hand configured furnace roof system. An external circulation system (not shown) utilizes coolant supply pipe 30 and coolant drain pipes 36*a* and 36*b*, respectively, to supply coolant to and drain coolant from the coolant connection means of roof 10. The coolant circulation system normally comprises a coolant supply system and a coolant collection system, and may also include coolant recirculation means.

Attached to coolant supply pipe 30 is flexible coolant supply hose 31 which is attached by quick release coupling or other means to coolant inlet pipe 26 on the periphery of furnace roof 10. As shown best in FIGS. 2 and 2*a*, inlet 26 leads to an inlet manifold 29 which extends around central delta opening 32 in the unpressurized interior of roof 10. Branching radially outward from manifold 29 in a spoke like pattern is a plurality of spray header pipes 33 to deliver the coolant to the various sections of the roof interior 23. Protruding downward from various points on each header 33 is a plurality of spray nozzles 34 which direct coolant in a spray or fine droplet pattern to the upper side of roof lower panels 38, which slope gradually downwardly from center portion of the roof to the periphery. The cooling effect of the spray coolant on the lower panels 38 enables the temperature thereon to be maintained at a predetermined temperature range, which is generally desired to be less than the boiling point of the coolant (100° C. in the case of water).

After being sprayed onto the roof lower panels 38, the spent coolant drains by gravity outwardly along the top of roof lower panels 38 and passes through drain inlets or openings 51*a*, 51*b* and 51*c* in a drain system. The drain system shown is a manifold which is made of rectangular cross section tubing or the like divided into segments 47*a* and 47*b*. As seen in FIG. 2, drain openings 51*a* and 51*b* are on opposite sides of the roof and aligned perpendicular to the tilting axis of the furnace. The drain manifold takes the form of a closed channel extending around the interior of the roof periphery at or below the level of roof lower panels 38 and is separated by partitions or walls 48 and 50 into separate draining segments 47*a* and 47*b*. Drain manifold segment 47*a* connects drain openings 51*a*, 51*b* and 51*c* with coolant outlet pipe 28*a*. Drain manifold segment 47*b* is in full communication with segment 47*a* via connection means 44 (in a manner which will be explained in more detail later) and connects drain openings 51*a*, 51*b* and 51*c* with coolant outlet pipe 28*b*. Flexible coolant drain hose 37 connects outlet 28*a* to coolant drain pipe 36*a* while flexible coolant drain hose 35 connects outlet 28*b* and coolant drain pipe 36*b*. Quick release or other coupling means may be used to connect the hoses and pipes. The coolant collection means to which coolant drain pipes 36*a* and 36*b* are connected will preferably utilize jet or other pump means to quickly and efficiently drain the coolant from the roof 10. Any suitable other means to assist draining of the coolant may also be utilized.

Although they are not used as such during left-handed operation of the furnace roof system as shown in FIGS. 1, 2, 2*a* and 5, the present invention also provides for a second coolant connection means which may be used in a right-handed installation of roof 10. This second or right-handed coolant connection means comprises coolant inlet 40 and coolant outlet 42. The left and right-handed coolant connection means are on opposite sides of roof 10 relative to a line passing through mast pivot point 24 and the center of the roof, and lie in adjacent quadrants of the roof. As with left-handed coolant inlet pipe 26, right-handed coolant inlet pipe 40 is connected to inlet manifold 29. As with the left-handed coolant outlet 28, right-handed coolant outlet 42 includes separate outlet pipes 42*a* and 42*b* which communicate with the separate segments 47*a* and 47*b* of the coolant drain manifold which are split by partition 50. To prevent coolant from escaping through the right-handed coolant connection means during installation of roof 10 in a left-handed system, the present invention also provides for capping means to seal the individual roof coolant inlets and outlets. A cap 46 may be secured over the opening to coolant inlet 40. A removable U-shaped conduit or pipe connector 44 connects and seals the separate coolant outlet openings 42*a* and 42*b* to prevent leakage from the roof and to provide for continuity of flow between drain manifold segments 47*a* and 47*b* around partition 50. Where the draining coolant is under suction, connector 44 also prevents atmospheric leakage into the drain manifold sections.

During operation of the furnace roof of the present invention as installed in a left-handed furnace roof system, coolant would enter from coolant circulation means through coolant pipe 30, through hose 31, and into coolant inlet 26 whereupon it would be distributed around the interior of the roof by inlet manifold 29. Coolant inlet 40, also connected to inlet manifold 29, is reserved for right-handed installation use and therefore would be sealed off by cap 46. After coolant is sprayed from nozzles 34 on spray headers 33 to cool the roof bottom 38, the coolant is collected and received through drain openings 51*a*, 51*b* and 51*c* into the drain manifold extending around the periphery of the roof 10 and exits through coolant outlet 28. As seen in FIG. 2, coolant draining through openings 51*a*, 51*b* and 51*c* on segment 47*a* of the drain manifold many exit the roof directly through coolant outlet 28*a*, through outlet hose 37 and into drain outlet pipe 36*a* before being recovered by the coolant collection means. Coolant draining through openings 51*a*, 51*b* and 51*c* on segment 47*a* of the drain manifold may also travel through coolant outlet 42*b*, through U-shaped connector 44, and back through coolant outlet 42*a* into manifold segment 47*b* in order to pass around partition 50. The coolant would then drain from drain manifold segment 47*b* through coolant outlet 28*b*, outlet hose 35 and through drain pipe 36*b* to the coolant collection means. Right-handed coolant outlet 42 is not utilized to directly drain coolant from the roof, but is made part of the draining circuit through the use of U shaped connector 44. When the furnace is level, coolant tends to drain equally through openings 51*a*, 51*b* and 51*c* and be split between outlets 28*a* and 28*b*. When the furnace is tilted, the coolant will drain through the drain openings on the lower side of the roof in the direction of the tilt and tend to exit from the closer of the outlets 28*a* or 28*b*. Upon being drained from the roof, the coolant may either be discharged elsewhere or may be recirculated back into the roof by the coolant circulation system. It is important to note that left-handed coolant connection means 26 and 28 are positioned on roof 10 closely adjacent to the location of mast structure 14 to minimize hose length. Viewing the mast structure 14 as being located at a 6 o'clock position, the left-handed coolant connection means is located at a 7 to 8 o'clock position.

The division of the drain manifold into discrete sections enables quick and efficient removal of spent coolant, even during tilting of the furnace. For example, in the left-handed installation depicted in FIG. 2, should roof 10 be tilted so that the left side is lower than the right, most of the spent coolant would flow toward and into drain openings 51*a* while little or no coolant would flow into drain openings 51*b*. If the furnace remains in a tilted position for a sufficient time, coolant would be completely pumped out of the sections between drain openings 51*b* and drain outlet 28*b* (manifold segment 47*b*, connector 44, and a portion of manifold segment 47*a*), while coolant still completely filled and was being pumped out of the portion of drain manifold segment 47*a* between drain openings 51*a* and drain outlet 28*a*. Partition 48 enables a pressure differential (i.e., suction) to be maintained at drain openings 51*a* and drain outlet 28*a* and permits coolant removal to continue independently therethrough even though only air and no coolant is present at drain outlet 28*b*. Likewise, should the furnace be tilted in the opposite direction, independent coolant removal may continue through drain outlet 28*b* even though coolant is no longer flowing out of drain outlet 28*a*. It is preferred that separate pump means be connected to each of the drain outlets 28*a* and 28*b* to ensure independent coolant removal through each drain outlet.

Should the roof system shown in FIGS. 1, 2, 2*a* and 5 be employed in a right-handed roof installation, instead of the left-handed installation as shown, the right-handed coolant connection means 40 and 42 would be in communication with a coolant circulation system instead of the left-handed coolant connection means 26 and 28. Coolant inlet cap 46 would be placed over coolant inlet 26 and coolant inlet 40 would be connected to the coolant supply means by the appropriate hoses and pipes. Likewise, U shaped connector 44 would be placed between coolant outlets 28*a* and 28*b* to prevent coolant leakage through these outlets and provide full connection between drain manifold segments 47*a* and 47*b* around partition 48. Coolant may be removed through drain openings 51*a*, 51*b* and 51*c* and may exit the drain manifold through outlets 42*a* and 42*b*. Coolant outlet 42*a* would then drain coolant from drain manifold segments 47*a* through segment 47*b* while coolant outlet 42*b* would drain coolant directly from drain manifold segment 47*a*. Each coolant outlet 42*a* and 42*b* would be connected by the appropriate drain hoses to the coolant collection means. As shown in FIG. 2, the right-handed coolant connection means is located at a 4 to 5 o'clock position, and would be closely adjacent to and minimize connecting hose length with a mast structure located at a 6 o'clock position.

As with the left-handed installation, a right-handed installation of roof 10 should employ separate pump means to permit independent coolant removal through each drain outlet 42*a* and 42*b* during furnace tilting. Partition 50 would then divide the manifold segments to maintain proper pressure differential for coolant removal at the lower of the drain openings 51*a* or 51*b* while no coolant was being removed through the other drain openings 51*b* or 51*a*.

Figure 2A:
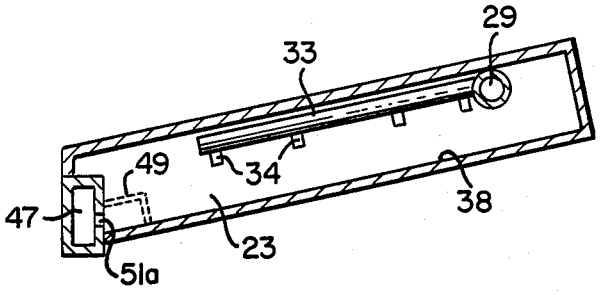
FIG. 2*a* is a cross sectional view along the line 2*a*–2*a* of FIG. 2.
Figure 6A:
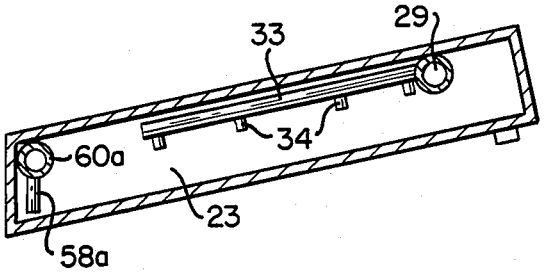
FIG. 6*a* is a side cross sectional view along the line 6*a*—6*a* of FIG. 6.
Figure 6:
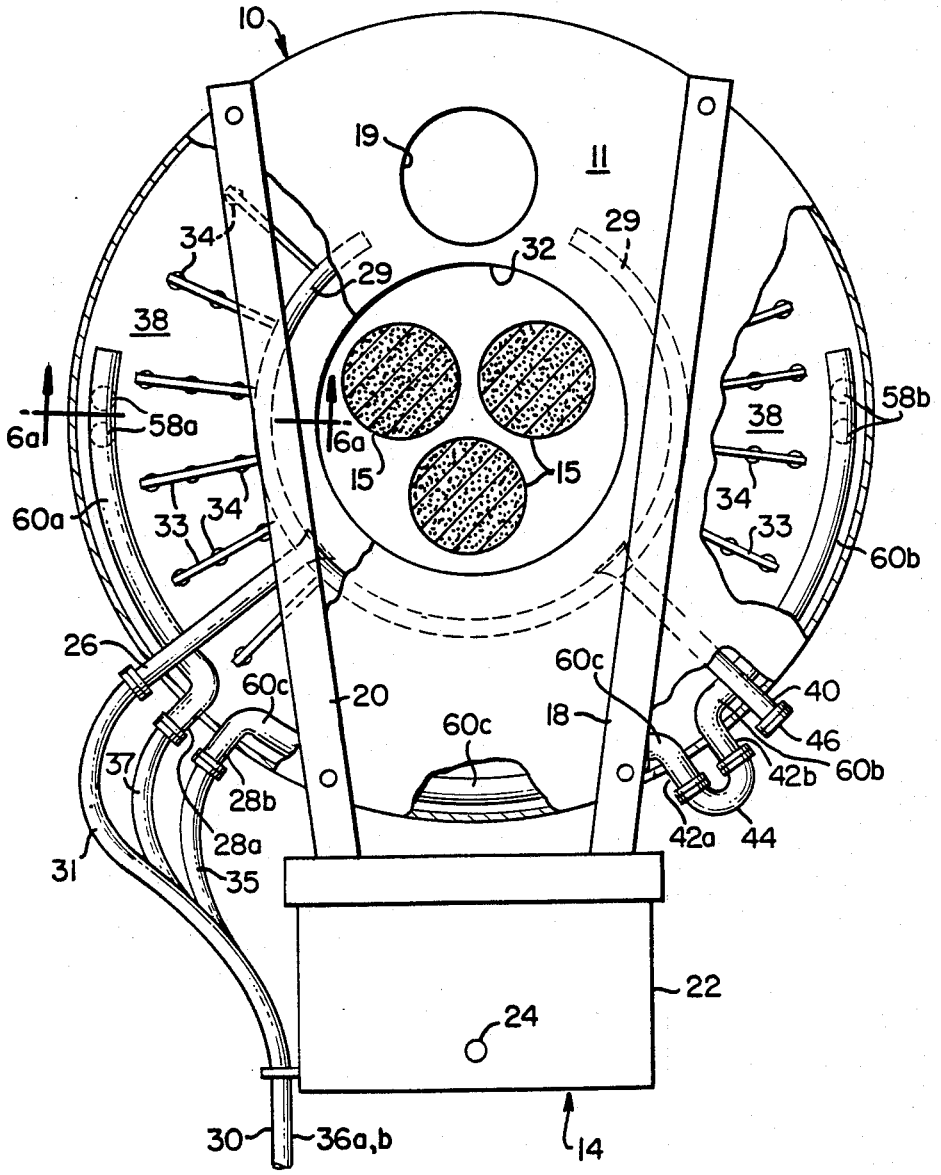
FIG. 6 is top plan view, partially cut away and partially in section, of a second embodiment of the furnace roof and supporting mast structure of FIG. 1.

A second embodiment of the preferred furnace roof is shown in FIGS. 6 and 6*a* illustrating top and cross sectional views of roof 10. The embodiment in FIGS. 6 and 6*a* is identical to that shown in FIGS. 2 and 2*a* except for the configuration of the drain manifold. Instead of having the channel-type drain manifold with side drain openings (as shown in FIGS. 2 and 2*a*), the drain system comprises conduit having a series of tubing segments 60*a*, 60*b* and 60*c* which extend approximately in a semicircle around the interior of the roof periphery and which utilize as drain inlets vertical scavenger or suction pipes 58*a* and 58*b* to remove standing spent coolant from the interior of the roof. A pair of downwardly extending vertical scavenger pipes, 58*a* and 58*b*, are located on each side of the furnace roof approximately 180 degrees apart (corresponding to the locations of drain openings 51*a* and 51*b* of FIG. 2) and are adapted to remove spent coolant, while the furnace is level or as the furnace is tilted to either side. Drain system sections 60*a*, 60*b* and 60*c* comprise a conduit such as tubing or the like. Conduit section 60*a* connects scavenger tubes 58*a* to drain outlet 28*a* while conduit section 60*b* connects scavenger tubes 58*a* to drain outlet 42*b*. Conduit section 60*c* connects drain outlet 28*b* to drain outlet 42*a*. In a left-handed installation as shown, connector 44 allows conduit section 60*b* to communicate fully with conduit section 60*c* and drain outlet 28*b* and permit unobstructed coolant flow. As spent coolant flows down the inside of roof lower panel 38 and reaches a level of the lower opening of scavenger pipes 58*a* and 58*b*, a jet pump, suction-type pump or other means enables the coolant to be sucked up through scavenger pipes 58*a* and 58*b* and exit from the roof through outlets 28*a* and 28*b* respectively. For a right-handed roof installation, the connector 44 would be placed between drain outlets 28*a* and 28*b* whereupon conduit section 60*a* would then be in communication with conduit section 60*c* and drain outlet 42*a*, thereby enabling water to be removed via scavenger pipes 58*a* and 58*b* through drain outlets 42*a* and 42*b* respectively.

In a manner analagous to that described with reference to the first embodiment of the drain manifold (FIGS. 2 and 2*a*), the use of separate pump means for each one of the pair of drain outlets 28*a*, 28*b* or 42*a*, 42*b* permits independent coolant removal through either or both of scavenger pipes 58*a* and 58*b*. Even during tilting of the furnace 12 where one set of scavenger pipes 58*a* or 58*b* is at the upper side above the level of the spent coolant, the segmenting of the drain manifold into discrete sections permits suction to be maintained at the other set of scavenger pipes 58*b* or 58*a* at the lower side below the level of the coolant.

The removal of the roof system of the present invention is shown in a left-handed furnace installation in FIG. 3 and in a right-handed furnace installation in FIG. 4. As shown in FIG. 3, roof 10 is being removed by mast 14 (in a 3 o'clock position) rotating in a counterclockwise direction from the position in which the roof is normally in place over the furnace 12. Left-handed coolant inlet 26 and coolant outlets 28 are shown connected to the drain hoses in the manner shown in FIGS. 1, 2, 5 and 6. Right handed coolant inlet 40 is sealed off by cap 46 while the two right-handed coolant outlets 42*a* and 42*b* are sealed and connected by U-shaped connector pipe 44. As roof 10 is removed from the furnace in the clockwise direction, the left-handed coolant connection means 26 and 28 and their associated hoses are on the side of the roof opposite the side which passes over the interior of furnace 12 to prevent the hoses from being exposed to the hot interior of the furnace. The right-handed connection means 40 and 42 and the associated caps 44 and 46, positioned on the side of the furnace which passes over the furnace 12 interior, are protected from the effects of the hot interior of the furnace because of the presence of coolant therein.

The same roof 10 shown in FIG. 3 is shown again in FIG. 4, this time as installed in a right-handed furnace roof installation. The furnace, mast, hoses, and supply and drain pipes are substantially similar to that shown in FIG. 3 except that the installation is set up to remove roof 10 in a horizontal clockwise direction. The features of the furnace, mast, hoses and drain pipes in FIG. 4 are numbered the same as the corresponding components in FIG. 3, except that the numeral "1" is placed before each identifying numeral. In this right-handed installation, roof 10 is again supported by chain, cable or other roof lift members (not shown in this view) from mast arms 118 and 120 which extend horizontally outward from mast support 122. Although mast 114 is shown located in a 9 o'clock position (180° directly opposite the position of mast 14 in FIG. 3), it is in the same position as mast 14 relative to roof 10 and its coolant connection means. Mast 114 rotates clockwise around pivot point 124 to remove roof 10 from furnace 112.

In FIG. 4, right-handed coolant connection means 40 and 42 is now operatively connected to the coolant circulation system (not shown) and the left-handed coolant connection means 26, 28 is disconnected from the coolant circulation system. Cap 46 seals off the opening in coolant inlet 26 while connector 44 connects the two coolant outlets 28*a* and 28*b*. The right-handed coolant inlet 40 is connected by flexible hose 131 to the coolant supply pipe 130 while coolant drains 42*a* and 42*b* are respectively connected to flexible drain hoses 135 and 137 which, in turn, are respectively connected to drain pipes 136*a* and 136*b*.

Right-handed coolant connection means 40 and 42 are thus located adjacent to roof mast 114 to minimize the length of the connecting hoses. As mast 114 rotates clockwise around point 124 to remove furnace roof 10 from furnace 112, the right-handed coolant connection means 40 and 42, and the associated hoses, are again located on the side of the roof opposite the side which passes over the interior of the furnace. Consequently, these connection means and hoses are not exposed to the hot interior of furnace 112 when roof 10 is removed during or immediately after operation of the furnace. The disconnected left-handed coolant connection means 26 and 28, and their associated caps, now located on the side of the furnace roof which may be exposed to the hot furnace interior, are protected from the effect of such heat by the presence of coolant therein.

The combination roof systems of the present invention, in both left- and right-handed installation, provides coolant connection means on the furnace roof directly adjacent the roof mast structure to minimize connecting hose length. Regardless of whether the roof is installed in a left or right-handed system, the roof is mounted in the same orientation relative to the mast structure. Additionally, where the water-cooled roofs have two, three or more different segments for coolant draining, the present invention provides for appropriate connectors to provide communication and continuity of coolant draining between at least two of the segments.

As a result of the roof system of the present invention, a single furnace roof may be utilized in both right-handed and left-handed furnace roof installations. This improved furnace roof system may be modified from existing roof systems in a simple and cost effective manner to provide for such combination usage. As a result, those plants and operations which have both left-handed and right-handed furnace roof installations need not keep separate spare roofs on hand for emergency replacement and may instead rely on a common roof as a backup for both types of installations. Considerable cost savings may thus be achieved by avoiding the purchase of a separate roof where it is not otherwise needed and through the reduced inventory carrying costs.

The roof system of the present invention may be utilized in various types of molten material furnaces or other types of installations where it is desired to have a roof capable of being removed in opposite directions, as described herein. It will be apparent to those skilled in this art that the specific locations of the separate coolant connection means may be changed to accommodate various furnace installations. Additionally, more than the two coolant connection means described herein and shown in FIGS. 1 through 6*a* may be utilized effectively. Also instead of a pivoting mast to remove the roof other means may be utilized for example, overhead cranes, etc. and the specific means for removal is not critical to the operation of the present invention.

While this invention has been described with reference to specific embodiments, it will be recognized by those skilled in the art that variations are possible without departing from the spirit and scope of the invention, and that it is intended to cover all changes and modifications of the invention disclosed herein for the purpose of illustration which do not constitute departure from the spirit and scope of the invention.

Having thus described the invention, what is claimed is:

1. A roof system adapted for use on furnaces having roof removal in different directions comprising:

a furnace roof having at least a portion thereof spray cooled by a coolant;

a coolant drain system for receiving spent coolant from the spray cooled portion of said roof, said drain system being divided into at least two segments;

a first set of coolant outlets on said drain system for connection with a coolant collection system, each outlet of said first set of outlets being associated with a different one of said drain system segments;

a second set of coolant outlets on said drain system for connection with a coolant collection system, each outlet of said second set of outlets being associated with a different one of said drain system segments; and connection means between the outlets of said first or second set of coolant outlets to permit unobstructed communication between drain system segments while the other of said first or second set of coolant outlets is connected with said coolant collection system to remove spent coolant from said roof.

2. The roof system of claim 1 wherein said coolant drain system includes drain inlets on opposing sides of said roof for receiving said spent coolant; and wherein one of said drain inlets is in direct communication with one of the coolant outlets connected to said coolant collection system for removal of spent coolant, and the opposite drain inlet is in communication with another of the drain outlets connected to said coolant collection system, through said connection means, for removal of spent coolant.

3. The roof system of claim 2 wherein said coolant collection system comprises a separate pump means for each of the connected coolant outlets for independently removing spent coolant therefrom.

4. The roof system of claim 1 wherein each of said first and second set of coolant outlets comprises a pair of adjacent coolant outlets.

5. The roof system of claim 1 wherein said coolant drain system is located at the periphery of said roof and wherein said drain system segments correspond to different portions of said roof periphery.

6. The roof system of claim 4 wherein said connection means comprises a removable conduit adapted for use with either set of said pairs of coolant outlets.

7. The roof system of claim 6 wherein said conduit is U-shaped.

8. The roof system of claim 1 wherein said drain system comprises a closed channel extending along the periphery of said roof and having drain openings therein for receiving said spent coolant, said channel containing partitions dividing said drain system into said segments.

9. The roof system of claim 1 wherein said drain system comprises conduit extending along the periphery of said roof and having downwardly extending tubes for receiving said spent coolant, said conduit consisting of a plurality of discrete sections forming said segments.

10. The roof system of claim 2 assembled on a furnace and said furnace is adapted for tilting in opposite directions and wherein said opposing drain openings are aligned perpendicular to the tilting axis.

11. A roof system adapted for use in tilting electric arc furnaces having roof removal in either a clockwise or a counterclockwise direction comprising:

an electric arc furnace roof having at least a portion thereof spray cooled by a coolant;

a coolant drain system having drain inlets on opposite sides of said roof, aligned perpendicular to the furnace tilting axis, for receiving spent coolant from the spray cooled portion of said roof, said drain system located at the periphery of said roof and divided into at least two segments corresponding to different portions of the roof periphery;

a first pair of adjacent coolant outlets on said drain system for connection with a coolant collection system when said roof is secured for removal in a clockwise direction, each of said first pair of outlets being associated with a different one of said drain system segments;

a second pair of adjacent coolant outlets on said drain system, spaced from said first pair, for connection with a coolant collection system when said roof is secured for removal in a counterclockwise direction, each of said second pair of outlets being associated with a different one of said drain system segments; and removable connection means between one of said first or second pair of coolant outlets to permit unobstructed communication between drain system segments while the other of said first or second pair of coolant outlets is connected with said coolant collection system, one of said drain inlets being in direct communication, through a drain system segment, with one of the pair of drain outlets connected to said coolant collection system for removal of spent coolant, the opposite drain inlet being in communication, through said connection means, with the other of the pair of drain outlets connected to said coolant collection system for removal of spent coolant.

12. The roof system of claim 11 wherein said connection means comprises a U-shaped conduit adapted for use with either of said pairs of coolant outlets.

13. The roof system of claim 12 wherein said coolant collection system includes separate pump means for each of the connected drain outlets for independently removing spent coolant therefrom.

14. The roof system of claim 13 wherein said drain system comprises a closed channel extending along the periphery of said roof and having drain openings therein for receiving said spent coolant, said channel containing partitions dividing said drain system into said segments.

15. The roof system of claim 13 wherein said drain system comprises conduit extending along a portion of the periphery of said roof and having downwardly extending tubes for receiving said spent coolant, said conduit comprising a plurality of discrete sections forming said segments.

* * * * *